US005273003A

United States Patent [19]

Rothwell

[11] Patent Number: 5,273,003

[45] Date of Patent: Dec. 28, 1993

[54] CYCLONE FURNACE WITH INCREASED TUBE WALL MATERIAL

[75] Inventor: Fredrick A. Rothwell, Uniontown, Ohio

[73] Assignee: The Babcock & Wilcox Company, New Orleans, La.

[21] Appl. No.: 972,179

[22] Filed: Nov. 4, 1992

Related U.S. Application Data

[63] Continuation of Ser. No. 854,926, Mar. 20, 1992, abandoned.

[51] Int. Cl.[5] ..... F22B 15/00; F22B 25/00; F22B 37/10

[52] U.S. Cl. ..... 122/235.28; 110/264; 122/617; 122/235.12

[58] Field of Search ..... 122/6; 110/264, 234

[56] References Cited

U.S. PATENT DOCUMENTS 2,979,000 4/1961 Sifrin et al. ..... 122/235.28 X
3,056,388 10/1962 Seidl et al. ..... 122/235.28 X
3,081,748 3/1963 Koch ..... 122/406
3,124,086 3/1964 Sage et al. ..... 110/264

OTHER PUBLICATIONS

*Steam: Its Generation and Use*—Copyright © 1975 The Babcock & Wilcox Company—Ch. 10—Cyclone Furnaces.

*Primary Examiner*—Edward G. Favors
*Attorney, Agent, or Firm*—Eric Marich; Vytas R. Matas; Robert J. Edwards

[57] ABSTRACT

A cyclone furnace includes a cyclone cylinder having five separate tubular water circuit panels which are serviced by substantially independent lower inlet upper outlet header segments. One hundred and twenty three tubes each having a 1.125" OD and 0.210" MWT replaces 134 smaller OD and thinner MWT tubes of the prior art, for increasing the available sacrificial material by more than a factor of two, without substantially increasing pressure drop in the forced circulation system.

7 Claims, 2 Drawing Sheets

CYCLONE FURNACE WITH INCREASED TUBE WALL MATERIAL

This is a continuation of application Ser. No. 07/854,926 filed Mar. 20, 1992 abandoned.

FIELD AND BACKGROUND OF THE INVENTION

The present invention related in general to cyclone furnaces, and in particular to a new and useful cyclone furnace which utilizes tubes having increased outside diameter (OD) and increased wall thickness, for increasing the useful life of the furnace.

A cyclone furnace is a water-cooled horizontal cylinder in which fuel is fired, heat is released at extremely high rates, and combustion is completed. Its water-cooled surfaces are studded, and covered with refractory over most of their area. Coal is introduced into the burner end of the cyclone. About 20 percent of the combustion air, termed primary air, also enters the burner tangentially and imparts a whirling motion to the in-coming coal. Secondary air with a velocity of approximately 300 fps is admitted in the same direction, tangentially at the roof of the main barrel of the cyclone and imparts a further whirling or centrifugal action to the coal particles. A small amount of air (up to about 5%) is admitted at the center of the burner. This is known as "tertiary" air.

The combustible is burned from the fuel at heat release rates of 450,000 to 800,000 Btu/cu ft, hr, and gas temperatures exceeding 3000° F. are developed. These temperatures are sufficiently high to melt the ash into a liquid slag, which forms a layer on the walls of the cyclone. The incoming coal particles (except for a few fines that are burned in suspension) are thrown to the walls by centrifugal force, held in the slag, and scrubbed by the high-velocity tangential secondary air. Thus the air required to burn the coal is quickly supplied, and the products of combustion are rapidly removed.

The release of heat per cu ft in the cyclone furnace is very high. However, there is only a small amount of surface in the cyclone and this surface is partially insulated by the covering slag layer. Heat absorption rates range from 40,000 to 80,000 Btu/sq ft, hr. This combination of high heat release and low heat absorption assures the high temperatures necessary to complete combustion and to provide the desired liquid slag covering of the surface.

The gaseous products of combustion are discharged through a water-cooled re-entrant throat of the cyclone into a gas-cooling boiler furnace. Molten slag in excess of the thin layer retained on the walls continually drains away from the burner end and discharges through a slag tap opening, to the boiler furnace, from which it is tapped into a slag tank, solidified, and disintegrated for disposal.

By this method of combustion the fuel is burned quickly and completely in the small cyclone chamber, and the boiler furnace is used only for cooling the flue tapped into the slag tank under the boiler furnace. Thus, the quality of fly-ash is low and its particle size so fine that corrosion of boiler heating surfaces is not experienced even at high gas velocities.

U.S. Pat. No. 3,081,748 discloses an arrangement using multiple cyclone furnaces to service a single boiler. The furnaces each have multiple panels which are supplied with forced circulation fluid in a specific circuit to maximize heat absorption and plant efficiency.

A known boiler using a similar furnace design includes 134 parallel tubes which make up five water circuits covering the sides of the furnace barrel. Each tube is 1.031" OD and has a minimum wall thickness (MWT) of 0.180".

Many utility companies desire thicker tube construction, however for additional sacrificial tube surface material to extend the life of the tubes. This can only be done however, without any significant increase in pressure drop through the cyclone and while maintaining the same overall dimensions. The new furnace construction must fit within the space provided for the old cyclone furnaces, without any modifications to attaching equipment.

SUMMARY OF THE INVENTION

An object of the present invention is to provide a new cyclone furnace design and construction which maintains the same overall dimensions and location for connections of existing cyclone furnaces but which provides tubes having thicker walls and greater sacrificial tube surface material.

A further object of the present invention is to provide such a new and improved design which does not significantly increase pressure drop across the circuits of the cyclone furnace, in the forced circulation, once-through system.

According to the present invention, tube thickness and larger OD tubes are used which result in an increase of 2.417 times more sacrificial material than in prior art designs. This is at less than a one psi increase in pressure drop. Accordingly, the cyclone furnace of the present invention will last longer than known cyclone furnaces, without any change in boiler performance or overall boiler construction, or even in the hook-ups and connections necessary for fitting the new cyclone furnaces to the boiler.

Accordingly, a further object of the present invention is to provide a cyclone furnace with increased tube wall material, comprising: a cyclone cylinder defining a combustion chamber; a front wall (neck) connected to and partly covering one end of the cylinder, the front wall (neck) having a fuel inlet port therein for receiving fuel and combustion air into the cylinder; means defining an entry throat at an opposite end of the cylinder for discharging hot combustion gas from the cylinder; and the cyclone cylinder being formed of at least one tube panel containing 123 side-by-side tubes each having a 1.125" OD and 0.210" MWT, whereby increased tube wall material is provided in a cylinder having the same length and size of a cyclone cylinder having smaller OD and thinner MWT tubes.

A further object in the invention is to provide a cyclone furnace which is simple in design rugged in construction and economical to manufacture, while fitting in the same space and having substantially the same pressure drop as pre-existing cyclone furnaces in a once through forced circulation system.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
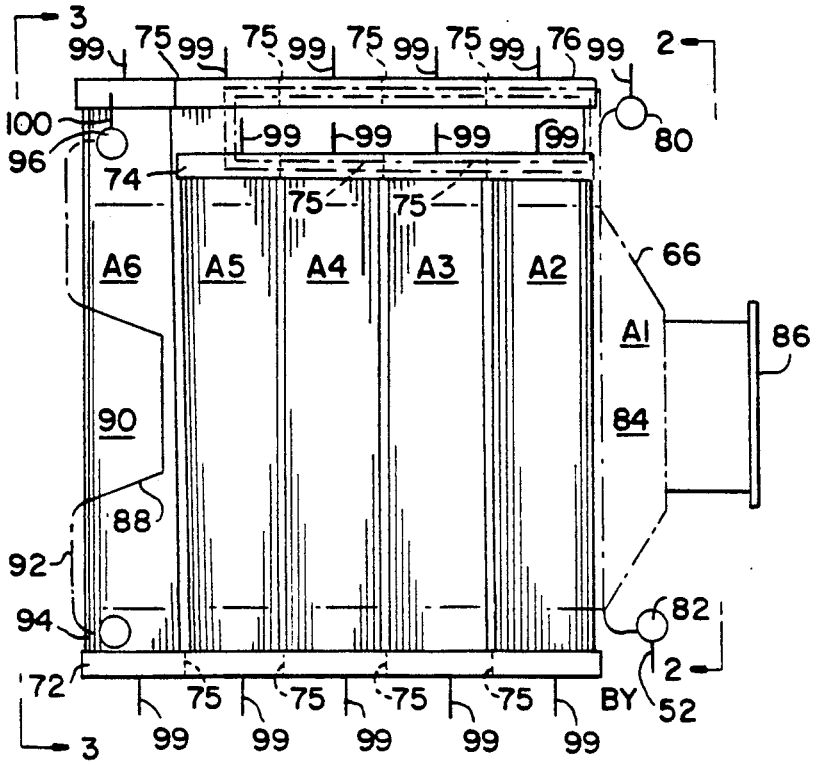
FIG. 1 is a side elevational view of cyclone furnace illustrating the present invention.
Figure 2:
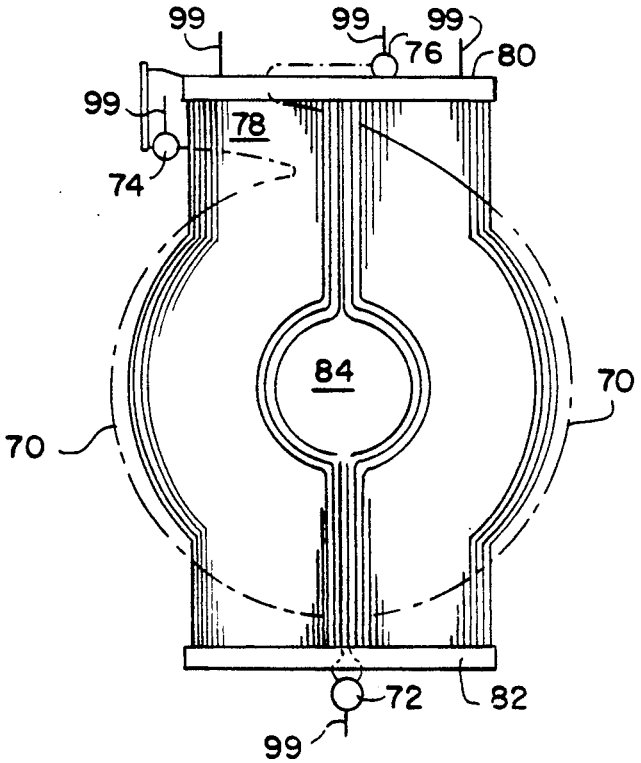
FIG. 2 is an elevational view taken along line 2—2 of FIG. 1, showing the front wall (neck) of the cyclone furnace.
Figure 3:
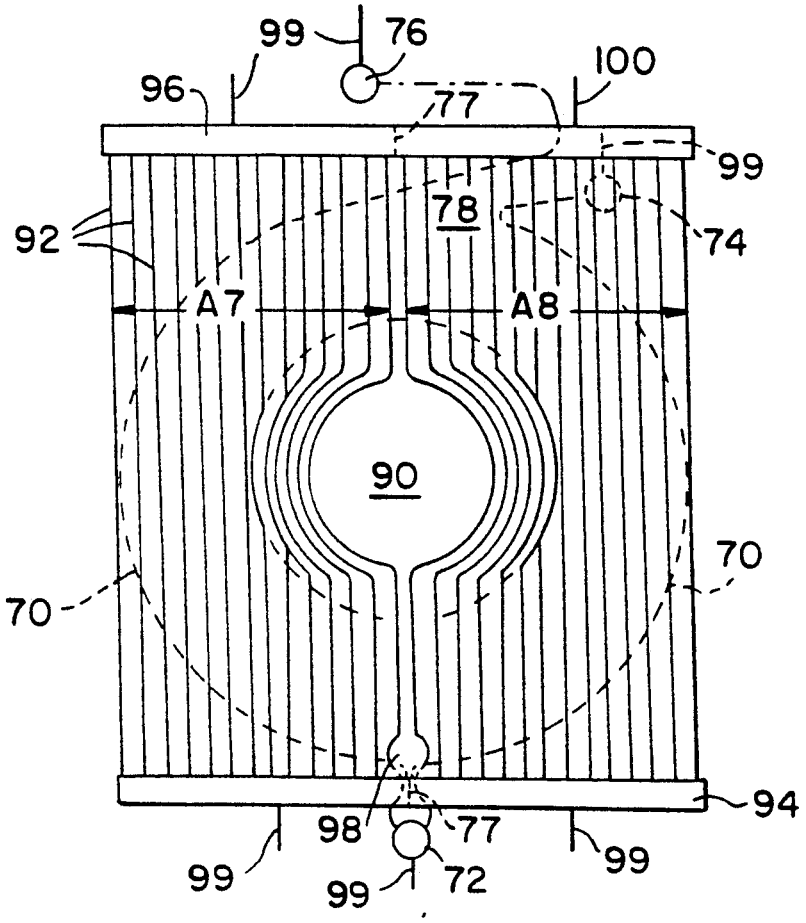
FIG. 3 is an elevational view taken along line 3—3 of FIG. 1, and showing the re-entrant throat wall of the furnace.

Referring to the drawings in particular, the invention embodied in FIGS. 1 to 3 comprises a cyclone furnace containing multiple tubular water circuit panels each connected to separate upper and lower headers, and constructed of larger outside diameter (OD) and thicker minimum wall thickness (MWT) tubes to increase sacrificial material available in the furnace and thus increase furnace life.

The cyclone furnace comprises a substantially cylindrical combustion chamber arranged with its major axis horizontal and having a frusto-conical extension or front wall (neck) 66 at the front, or outer end thereof, the circular boundary wall being formed by insulation covered metallic casing connected to the corresponding boundary wall of a boiler chamber (not shown) and lined by oppositely arranged groups of refractory covered closely spaced studded tubes 70. The tubes 70 along one side of the circumferential wall of the cylindrical portion of the combustion chamber have their inlet ends connected to a horizontal subdivided lower inlet header 72 and their discharge ends connected to a horizontal subdivided upper intermediate header 74 and the tubes 70 along the opposite side have their inlet ends connected to the header 72 and their discharge ends connected to a horizontal subdivided upper outlet header 76. The upper and lower ends of each tube 70 of the cylindrical portion of each combustion chamber are reversely bent, and have opposite tubes at the top of the chamber spaced apart to form a tangentially arranged combustion secondary air inlet 78 extending over a major portion of the length of the chamber and connected to an air supply duct (not shown). The tubes 70 along both sides of the circumferential wall of the frusto-conical neck portion 66 of the combustion chamber extend between horizontally arranged top outlet and bottom inlet headers 80 and 82, respectively, to form a tubular water circuit panel $A_1$, and have intermediate portions curved to define a circular fuel inlet port 84. A fuel inlet casing 86 of logarithmical curved peripheral formation registers with the port 84. The rear end of each combustion chamber is formed by a vertical wall positioned outside of and suitably connected to the corresponding boundary wall tubes of the furnace chamber and having a flaring re-entrant throat 88 forming a gas outlet 90 communicating with a corresponding opening of the furnace chamber. The wall and throat are formed by refractory covered closely spaced studded tubes 92 extending between horizontal subdivided lower inlet and upper outlet headers 94 and 96, respectively, with intermediate portions of certain tubes bent to form the throat and an opening 98 in the wall adjacent the bottom of the combustion chamber for the discharge of molten slag through a corresponding opening into the furnace chamber.

The fluid supply inlet header 82 for tubular water circuit panels $A_1$ of the combustion chamber are connected for parallel flow of fluid from downcomer of an economizer (not shown) by supply tubes 52. The headers 72, 74 and 76 of the combustion chamber are subdivided by transverse internal diaphragms 75 to group the wall tubes 70 into similar adjoining panels $A_2$, $A_3$, $A_4$, $A_5$, and $A_6$. The rear end wall inlet and outlet headers 94 and 96 of the combustion chamber are also subdivided by transverse internal diaphragms 77 to group the re-entrant throat tubes 92 into similar adjoining tube panels $A_7$ and $A_8$ on opposite sides of the vertical centerline of the wall.

The length of currently utilized cyclone furnaces is 11'10⅜", between the front wall (neck) 66 and the re-entrant throat wall 88, and along the six tubular water circuit panels $A_2$ through $A_6$. This length is accommodated by 134 tubes which alternate with 133 spaces. Each tube in the prior art is 1.031" OD×0.180" MWT. The inventor has found that it was not possible to arbitrarily replace the known tubes with thicker wall tubes without taking into account specific OD and wall thickness requirements, so that the cyclone furnace dimensions can be retained and at the same time increased pressure drop can be avoided. After considerable investigation into available options, it was found that 123 tubes alternating with 122 spaces of 1.125" OD×0.210" MWT tubes could accommodate substantially the same space (11'10 7/32") distributed among the five circuits in a way that substantially the same pressure drop exists as with the prior art, and just as importantly, the pressure drop per circuit is retained by selecting the number of tubes in each circuit.

The following table correlates the number of tubes and cross sectional flow area for each circuit in the prior art and each circuit of the present invention.

Also important is the fact that the same header connections 99 are attached for the present invention as in the prior art. Although FIG. 1 illustrates one header connection 99 for each lower inlet and upper outlet header segment is used, in an actual embodiment of the present invention, double header connections are provided for each lower inlet header segment and double header connections are provided for upper outlet header segments servicing panels $A_5$ and $A_6$ in the upper header. Single upper header connections are provided for panels $A_2$, $A_3$ and $A_4$.

For the front wall (neck) 66, the original 44 tubes per side of the front wall each of 1.031" OD×0.220" MWT are provided.

TABLE

| | PRIOR ART | | INVENTION | |
|---|---|---|---|---|
| Tube Panel | Number of Tubes | Flow Area | Number of Tubes | Flow Area |
| $A_2$ | 24 | 7.608 $in^2$ | 22 | 7.590 $in^2$ |
| $A_3$ | 24 | 7.608 $in^2$ | 22 | 7.590 $in^2$ |
| $A_4$ | 26 | 8.242 $in^2$ | 24 | 8.280 $in^2$ |
| $A_5$ | 28 | 8.876 $in^2$ | 26 | 8.970 $in^2$ |
| $A_6$ | 32 | 10.144 $in^2$ | 29 | 10.005 $in^2$ |
| Total | 134 | 42.478 $in^2$ | 123 | 42.435 $in^2$ |

As illustrated in the table, there is only slightly less flow area available according to the invention as opposed to the prior art and this results in an increase of pressure drop of less than 1 psi. Taking into account the increased wall thickness and increased OD of each tube, 2.417 times more sacrificial material is available in the tubes of the present invention over that of the prior art.

While a specific embodiment of the invention has been shown and described in detail to illustrate the application of the principles of the invention, it will be understood that the invention may be embodied otherwise without departing from such principles.

What is claimed is:

1. A cyclone furnace with increased tube wall material, comprising:

a cyclone cylinder defining a combustion chamber;

a front wall (neck) connected to and partly covering one end of the cylinder, the front wall (neck) having a fuel inlet port therein for receiving fuel and combustion air into the cylinder;

means defining an entry throat at an opposite end of the cylinder for discharging hot combustion gas from the cylinder; and the cyclone cylinder being formed of at least one tube panel containing 123 side-by-side tubes, whereby increased tube wall material is provided in a cylinder having the same length and size of a cyclone cylinder having smaller OD and thinner MWT tubes.

2. A cyclone furnace according to claim 1, wherein the cyclone cylinder contains a plurality of side-by-side tubular water circuit panels each serviced by a separate upper inlet and lower outlet header segment, tubes in each tube panel including total flow areas which increase from the front wall (neck) to the throat of the cylinder.

3. A cyclone furnace according to claim 2, wherein the cyclone cylinder includes five tubular water circuit panels having respectively 22, 22, 24, 26 and 29 tubes each, starting from the front wall.

4. A cyclone furnace according to claim 3, wherein each tube has an OD of 1.125".

5. A cyclone furnace according to claim 4, wherein each tube has a minimum wall thickness MWT of 0.210".

6. A cyclone furnace according to claim 1, wherein each tube has an OD of 1.125".

7. A cyclone furnace according to claim 1, wherein each tube has a minimum wall thickness of 0.210".

* * * * *